US011369199B1

(12) United States Patent
Zhang et al.

(10) Patent No.: US 11,369,199 B1
(45) Date of Patent: Jun. 28, 2022

(54) ANTI-TILT ASSEMBLY OF CABINET

(71) Applicant: Ningbo Eudemon Child Protective Equipement Co., Ltd., Zhejiang (CN)

(72) Inventors: Zhen Zhang, Zhejiang (CN); Yingfeng Chen, Zhejiang (CN)

(73) Assignee: Ningbo Eudemon Child Protective Equipment Co., Ltd.

( * ) Notice: Subject to any disclaimer, the term of this patent is extended or adjusted under 35 U.S.C. 154(b) by 0 days.

(21) Appl. No.: 17/157,148

(22) Filed: Jan. 25, 2021

(30) Foreign Application Priority Data

Dec. 31, 2020 (CN) ..... 202023344426.9

(51) Int. Cl.
*A47B 97/00* (2006.01)

(52) U.S. Cl.
CPC ..... *A47B 97/00* (2013.01); *A47B 2097/008* (2013.01)

(58) Field of Classification Search
CPC ..... A47B 97/00; A47B 2097/008
See application file for complete search history.

(56) References Cited

U.S. PATENT DOCUMENTS 4,047,773 A * 9/1977 Semany ..... A47B 87/0292 312/111
4,863,132 A * 9/1989 Fitzgerald ..... A47B 97/00 248/274.1
4,949,929 A * 8/1990 Kesselman ..... A47B 96/06 248/220.1
5,622,272 A * 4/1997 Orlando, Jr. ..... A47B 57/04 211/150
5,794,903 A * 8/1998 Peterson, II ..... A47B 97/00 248/300
6,220,562 B1 * 4/2001 Konkle ..... A47B 97/00 24/298
8,910,580 B1 * 12/2014 Cockrell ..... A47B 81/06 108/50.02
10,362,873 B1 * 7/2019 Farnsworth ..... A47B 97/00
10,813,456 B1 * 10/2020 Stravitz ..... A47B 91/12
10,912,384 B2 * 2/2021 Lager ..... A44B 11/00
10,939,761 B1 * 3/2021 Stravitz ..... A47B 88/57
2004/0046092 A1 * 3/2004 Jung ..... F25D 23/00 248/200

(Continued)

FOREIGN PATENT DOCUMENTS

CN 205493190 U 8/2016
JP H08131287 A 5/1996

(Continued)

*Primary Examiner* — Hanh V Tran
(74) *Attorney, Agent, or Firm* — Rumit Ranjit Kanakia

(57) ABSTRACT

The present disclosure relates to the technical field of household products, and in particular, relates to an anti-tilt assembly of a cabinet. The anti-tilt assembly includes a first anti-tilt member and a second anti-tilt member that are disposed at an angle of 90 degrees relative to each other. A first connecting surface configured to be connected to a fixing surface is defined outside the first anti-tilt member. A second connecting surface configured to be connected to the cabinet is defined under the second anti-tilt member. With such configuration, a top portion or an upper portion of the cabinet is fixed to the fixing surface, thereby achieving an anti-tilt effect.

8 Claims, 4 Drawing Sheets

(56) References Cited

U.S. PATENT DOCUMENTS

| | | | | |
|---|---|---|---|---|
| 2004/0129183 | A1* | 7/2004 | Owen | A47B 97/00 108/27 |
| 2008/0048075 | A1* | 2/2008 | Takao | F16M 13/02 248/176.1 |
| 2010/0326940 | A1* | 12/2010 | Donohoe | A47B 47/042 211/153 |
| 2012/0023707 | A1* | 2/2012 | Edwards | B62B 15/00 16/42 R |
| 2014/0263925 | A1* | 9/2014 | Essrig | A47B 97/00 248/505 |
| 2017/0127825 | A1* | 5/2017 | Melnick | F16B 1/00 |
| 2017/0314599 | A1* | 11/2017 | Kagramanyan | A47B 97/00 |
| 2019/0150617 | A1* | 5/2019 | Lager | A47B 97/00 |
| 2020/0383476 | A1* | 12/2020 | Marsden | A47B 95/008 |
| 2020/0386250 | A1* | 12/2020 | Berman | A47B 97/00 |
| 2021/0007485 | A1* | 1/2021 | Marsden | A47B 97/00 |
| 2021/0321773 | A1* | 10/2021 | Pierpont | A47B 97/00 |

FOREIGN PATENT DOCUMENTS

| | | | | | |
|---|---|---|---|---|---|
| JP | 10246212 | A | * | 9/1998 | A47B 97/00 |
| JP | 10323249 | A | * | 12/1998 | |
| JP | 3112455 | U | * | 8/2005 | |
| JP | 3122931 | U | * | 6/2006 | |
| JP | 2016116728 | A | * | 6/2016 | A47B 97/00 |

* cited by examiner

ANTI-TILT ASSEMBLY OF CABINET

TECHNICAL FIELD

The present disclosure relates to the technical field of household products, and in particular, relates to an anti-tilt assembly of a cabinet for fixing the cabinet and preventing tilt of the cabinet.

BACKGROUND

A cabinet is traditionally constituted by cabinet members, door flaps, fittings, table tops, and the like, and is used for accommodating cooking utensils and bearing a platform for cooking. Currently, the cabinets generally refer to various cupboards and cabinets used in daily life, including customized and finished and directly integrated ones. The cabinet is a commonly used furniture, which offers convenience for life but also induces some safety issues. Especially for the cabinet that is added subsequently, since the gravity center of the cabinet is high, tilt may occur due to climbs by children, opening of the drawers, or over-load at the upper chamber of the cabinet. This may cause hazards to safety of the users, especially for the children. Accidents caused to children due to the tilt of the cabinets in the worldwide frequently occur.

Therefore, where a cabinet exceeds a specific height, the issue of anti-tilt needs to be considered.

For example, Chinese Patent Application CN205493190U has disclosed an anti-tilt bottom plate of an indoor cabinet. Specifically, a connecting member is disposed at the bottom of the indoor cabinet to connect the feet and the metal bottom plate to lower the gravity center, and to define an integral body by connection to achieve an anti-tilt effect. However, the bottom plate is mounted at the bottom of the cabinet, and the actual effect thereof is limited and the assembly is inconvenient.

Japanese Patent Application JP08131287A has disclosed tip-over prevention device for furniture. Specifically, a hinge-like tip-over prevention device is disposed at the top of the furniture to fix the furniture onto the wall to achieve a tip-over prevention effect. Although this device achieves the expectation during normal use, screw fixing has a poor appearance, and it is inconvenient to drill holes on the wall. In addition, since the back of the subsequently added cabinet generally fails to be tightly attached to the wall due to the skirting. As a result, during use, the device may cause fixation failures in some screw holes, thereby affecting the fixation effect.

In summary, in view of the defects in the related art, it is desired to develop a new anti-tilt assembly of a cabinet to improve use safety of the household cupboards or cabinets.

SUMMARY

The present disclosure is intended to provide an anti-tilt assembly of a cabinet which is reasonable in structure and convenient in use, and is capable of achieving an anti-tilt effect.

To achieve the above objective, the present disclosure employs the following technical solution:

An anti-tilt assembly of a cabinet includes a first anti-tilt member and a second anti-tilt member that are respectively connected to a fixing surface and the cabinet; wherein the first anti-tilt member is disposed at an angle of 90 degrees or approximately 90 degrees relative to the second anti-tilt member, a second end of the first anti-tilt member is connected to a first end of the second anti-tilt member, or the first anti-tilt member and the second anti-tilt member are integrally molded.

The anti-tilt assembly of the cabinet further includes a third anti-tilt member; wherein the third anti-tilt member is disposed coplanar with the first anti-tilt member, the first anti-tilt member and the third anti-tilt member constitute a back plate; wherein the first connecting surface is disposed on an outer side surface of the back plate, and the first end of the second anti-tilt member is disposed in a middle area of the back plate to define a primary connecting member in a T shape or a quasi-T shape. In addition, in a Z axis direction, a ratio of a width of the first anti-tilt member to a width of the third anti-tilt member is 1:2 to 2:1 such that the second anti-tilt member is connected to a middle part of the back plate or within a region proximal to the middle part. In this way, when the back plate is fixed onto the wall by an adhesive, such a structural ratio causes the entire back surface of the back plate to withstand a force instead of single-point force withstanding, such that adhesive looseness may be effectively prevented, and the adhesion between the anti-tilt assembly and the wall may be enhanced.

The anti-tilt assembly of the cabinet further includes a secondary connecting member fitted into the through hole of the second anti-tilt member, wherein a fixing member is disposed on the secondary connecting member, the fixing member being fitted into the through hole such that the secondary connecting member is restrained by the second anti-tilt member in an X axis direction. In this way, the secondary connecting member fails to be displaced in the X axis direction. In addition, the fixing member may also be defined as a second connecting surface. In this case, whether a second connecting surface is disposed on the second anti-tilt member is not limited. By the above structure design with cooperated parts, the assembling of the anti-tilt assembly of the cabinet is more convenient, and the use effect is much more ensured. A sufficiently great adhesive surface is defined between the anti-tilt assembly and the wall by the first connecting surface of the back plate, such that the anti-tilt assembly is more securely fixed to the wall. Further, the T-shaped structure design also ensures a complete contact effect, and thus prevents adhesive looseness which impairs fixation. In addition, the fixing member of the secondary connecting member is adhered to the top surface of the cabinet, and a lateral adhesion force is produced. In this case, a sufficient action force may be produced only by a smaller contact area, such that the anti-tilt effect of the cabinet reaches the expectation, and meanwhile the anti-tilt assembly is convenient in installation and removal.

The anti-tilt assembly of the cabinet is compact in structure and convenient in use, and may be fixed to the wall by the adhesive or screws according to actual needs. In addition, the number of anti-tilt assemblies may be increased or decreased according to the height of the cabinet, to achieve a desired anti-tilt effect.

Furthermore, the use of the anti-tilt assembly according to the present disclosure is very convenient. Specifically, the back plate only needs to be adhered to the fixing surface such as the wall by the adhesive with reference to the placement of the cabinet. Since the back plate mates with the cabinet in terms of shape, positioning may be automatically implemented, and finally, the secondary connecting member or the second anti-tilt member is fixed to the cabinet.

DETAILED DESCRIPTION

Figure 1:
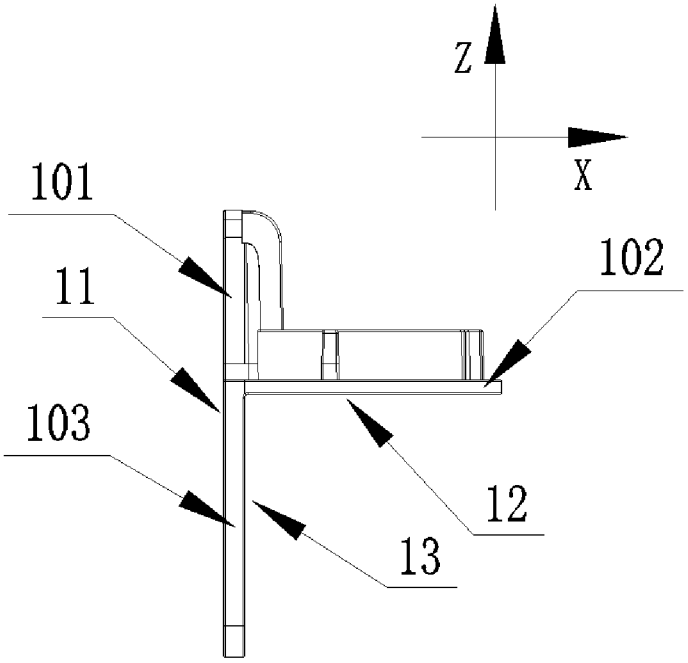
FIG. 1 is a schematic structural view of an anti-tilt assembly of a cabinet at a side view angle according to one embodiment of the present disclosure.
Figure 2:
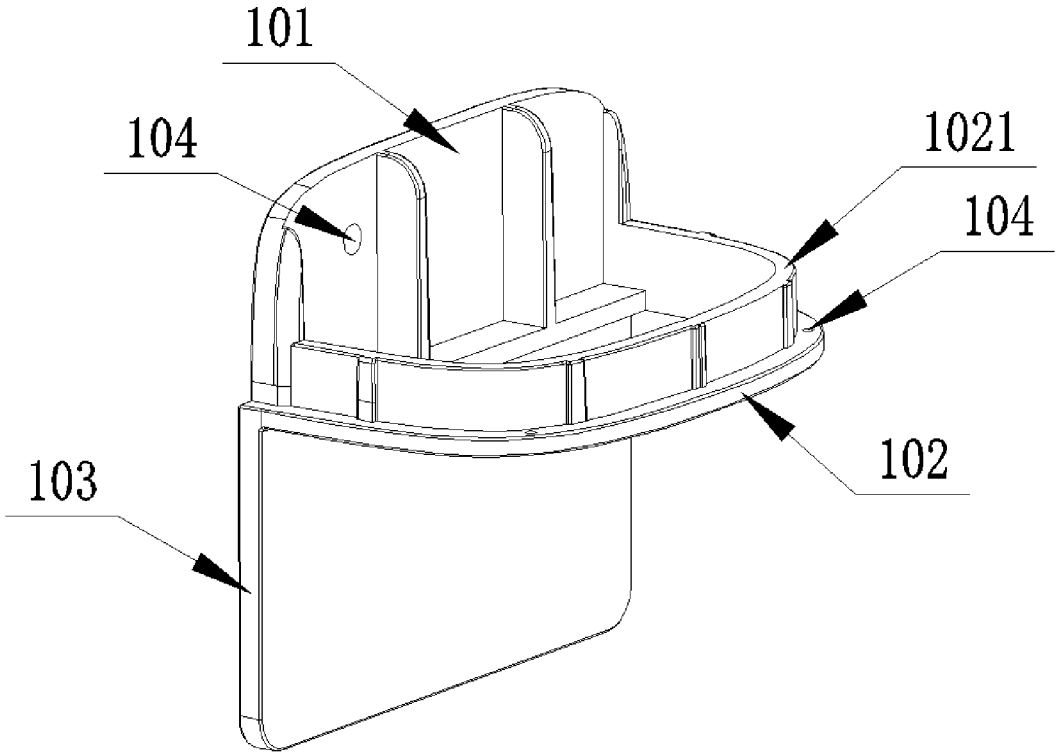
FIG. 2 is one schematic perspective structural view of the anti-tilt assembly of the cabinet according to the embodiment illustrated in FIG. 1, which is a schematic perspective structural view at a top view angle.
Figure 3:
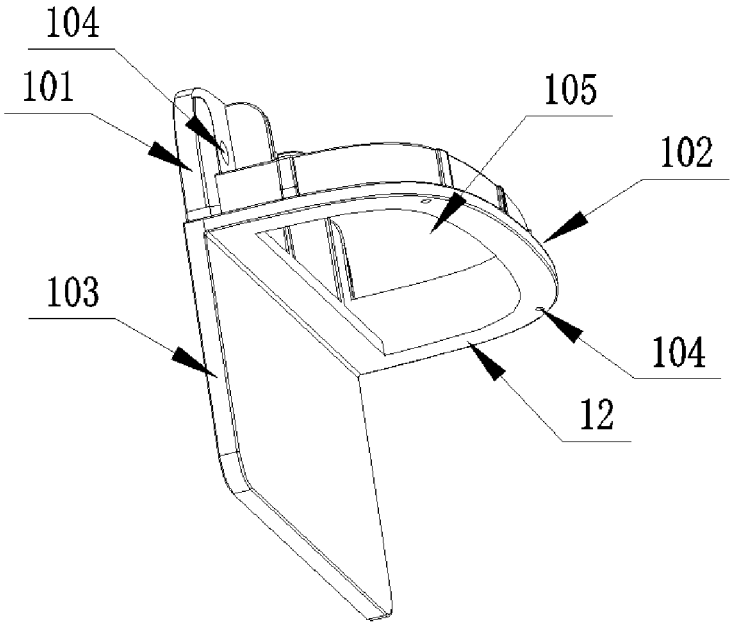
FIG. 3 is another schematic perspective structural view of the anti-tilt assembly of the cabinet according to the embodiment illustrated in FIG. 1, which is a schematic perspective structural view at a bottom view angle.
Figure 4:
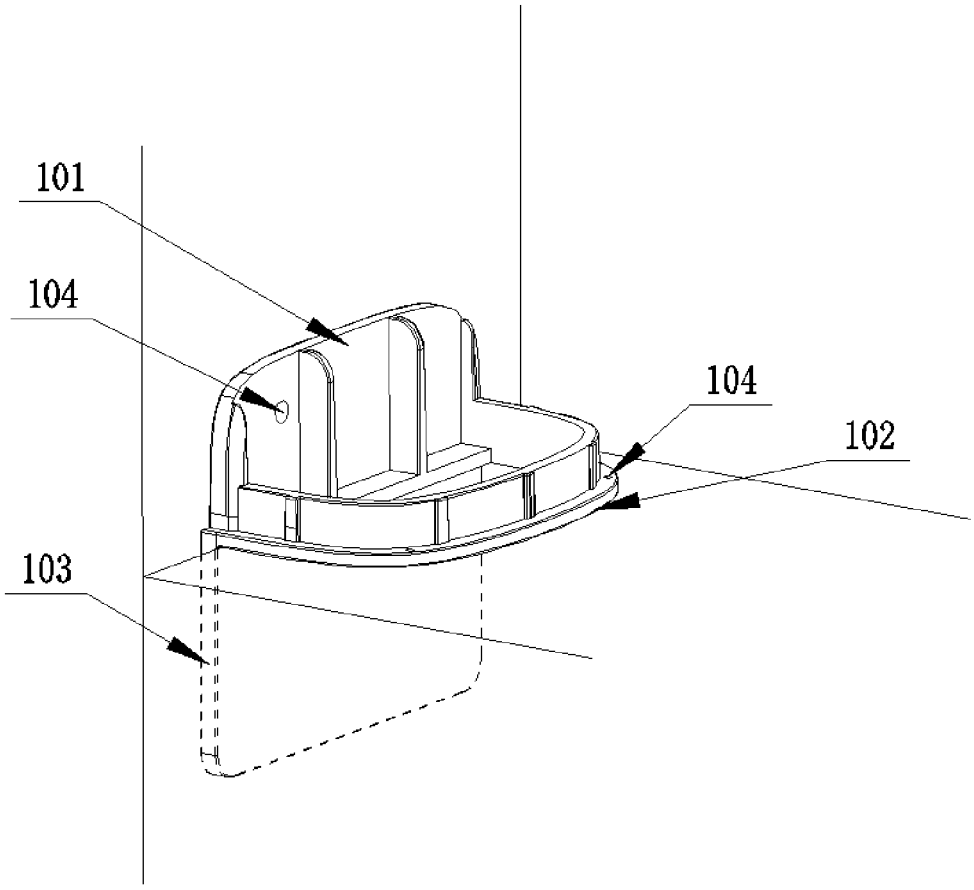
FIG. 4 is a schematic view of the anti-tilt assembly of the cabinet according to the embodiment illustrated in FIG. 1 being mounted on a wall and a top of the cabinet.
Figure 5:
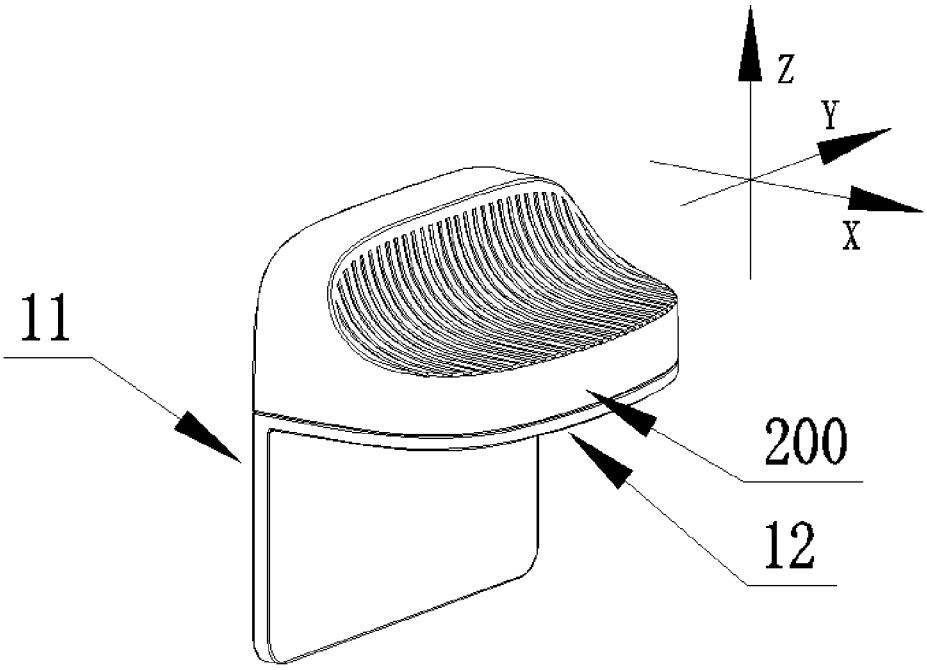
FIG. 5 is a schematic perspective structural view of an anti-tilt assembly of a cabinet according to another embodiment of the present disclosure, in which an anti-tilt assembly of a cabinet is additionally provided with a secondary connecting member based on the embodiment as illustrated in FIG. 1.
Figure 6:
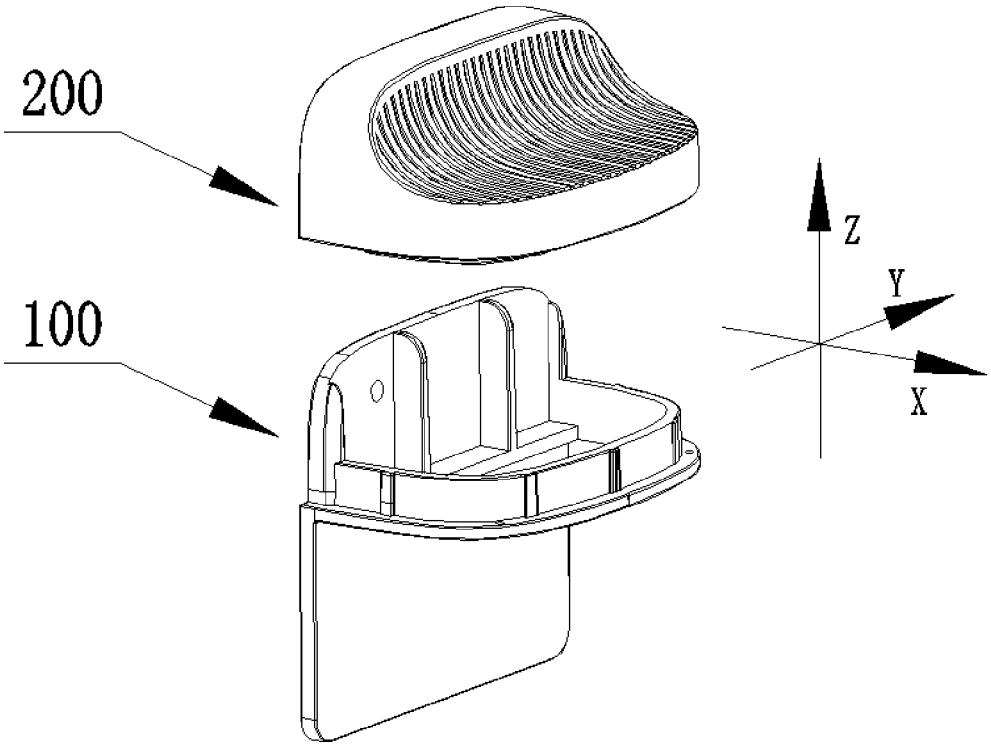
FIG. 6 is a schematic exploded structural view of the anti-tilt assembly of the cabinet according to the embodiment as illustrated in FIG. 5.
Figure 7:
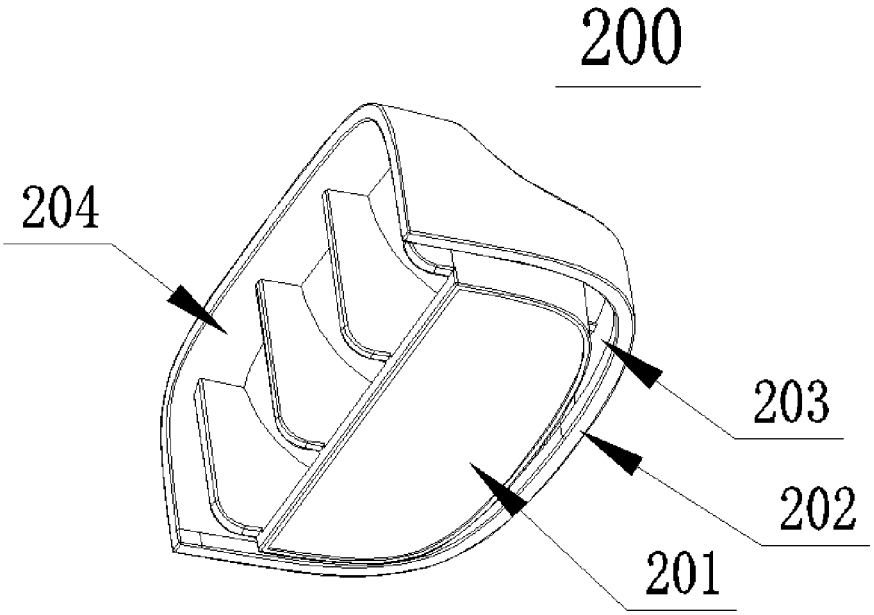
FIG. 7 is a schematic structural view of the secondary connecting member according to the embodiment as illustrated in FIG. 6, which is a schematic perspective structural view of the anti-tilt assembly of the cabinet at a bottom view angle.

For better understanding of the present disclosure by a person skilled in the art and for more clear definition of the protection scope of the present disclosure, the present disclosure is described hereinafter in detail with reference to some specific embodiments. It should be noted that the specific embodiments construed for the present disclosure are only illustrated, which are merely a part of embodiments of the present disclosure. The specific and direct descriptions of the related structures are only for ease of understanding of the present disclosure, and various specific features are not intended to directly limit the practice of the present disclosure. Any customary selections and replacements made by a person skilled in the art under the concept of the present disclosure shall all be considered as falling within the protection scope of the present disclosure.

An anti-tilt assembly of a cabinet mainly includes a first anti-tilt member 101 and a second anti-tilt member 102. The first anti-tilt member 101 is disposed at an angle of 90 degrees or approximately 90 degrees relative to the second anti-tilt member 102, such that a square shape or a quasi-square shape is defined. A second end of the first anti-tilt member 101 is connected to a first end of the second anti-tilt member 102, or the first anti-tilt member 101 and the second anti-tilt member 102 are integrally molded to define the anti-tilt assembly. For example, the first anti-tilt member 101 and the second anti-tilt member 102 may be engaged with each other by snap-fitting, heat welding, screw fixation, or the like; and most preferably, these two anti-tilt members are integrally molded.

A first connecting surface 11 is defined outside the first anti-tilt member 101, and a second connecting surface 12 is defined under the second anti-tilt member 102. The first connecting surface 11 is configured to be connected to such a fixing surface as a wall, and the second connecting surface 12 is configured to be connected to a top surface or a side upper portion of the cabinet (including a top portion on the side of the cabinet or a portion close to the top portion) to fix the top portion or the upper portion of the cabinet to the wall. From perspective of the actual anti-tilt effect, the anti-tilt assembly shall be as much as possible disposed close to the top portion of the cabinet, such that a better anti-tilt effect is achieved under the same or equivalent conditions.

The anti-tilt assembly may be connected to the wall or the cabinet, that is, the first anti-tilt member 101 may be connected to the wall and the second anti-tilt member 102 may be connected to the top surface or the side surface of the cabinet, by screws or an adhesive. In addition, regardless of whether the connection is practiced by the screws or the adhesive, such connection may apply to one member or two cooperated members. For example, when the first anti-tilt member 101 is fixed by screws, several screw holes may be disposed in the first anti-tilt member 101; or a fixing base is first fixed to the wall by the screws, and then the first anti-tilt member 101 and the fixing base are fixed to each other by shorter screws that are capable of connecting only these two; or the first anti-tilt member 101 and the fixing base are fixed in an X axis direction by a rivet structure (the first anti-tilt member 101 and the fixing base may be disposed as being capable of displacing relative to each other in an Y axis or Z axis direction).

In some embodiments, the first anti-tilt member 101 and the second anti-tilt member 102 are respectively provided with fixing holes 104 for the screws to pass through to fix the first anti-tilt member 101 and the second anti-tilt member 102 to the wall or the cabinet, such that the cabinet is fixed to achieve the anti-tilt effect.

In some other preferred embodiments, the anti-tilt assembly of the cabinet further includes a back adhesive. The back adhesive is fitted with the first connecting surface 11 and the second connecting surface 12. The back adhesive may be directly pre-applied on the first connecting surface 11 or the second connecting surface 12, or may be an independent part which is adhered to the first connecting surface 11 or the second connecting surface 12 during use. With respect to the anti-tilt assembly having a secondary connecting member 200, the back adhesive is preferably pre-applied on the first connecting surface 11 on an outer side surface of a back plate, and a bottom surface of the fixing member 201. In this case, whether the back adhesive is applied to a bottom surface of the second anti-tilt member 102 is not limited.

The back adhesive has two adhesive surfaces, the adhesive surface on one side of the back adhesive is adhered to the first connecting surface 11 or the second connecting surface 12, and the other side of the back adhesive is provided with a backing paper. By removing the backing paper, the anti-tilt assembly of the cabinet may be fixed by the adhesive, and the backing paper is not removed, the anti-tilt assembly of the cabinet may be fixed by the screws, and the back adhesive may be used as a buffer member.

In some embodiments, the anti-tilt assembly of the cabinet further includes a third anti-tilt member 103. The third anti-tilt member 103 is disposed coplanar with the first anti-tilt member 101. A first end of the third anti-tilt member 103 is connected to the second end of the first anti-tilt member 101 and the first end of the second anti-tilt member 102, such that a primary connecting member 100 in a quasi-T shape is defined.

The first anti-tilt member 101 and the third anti-tilt member 103 constitute the back plate, and these two members may be independent parts or may be integrally molded. The first connecting surface 11 is disposed on the entire or majority of the outer side surface of the back plate, and the first end of the second anti-tilt member 102 is disposed in a middle area of the back plate, which may be the middle part or an upper or lower position in the middle part; preferably the upper position in the middle part.

Preferably, in the Z axis direction, a ratio of a width of the first anti-tilt member 101 to a width of the third anti-tilt member 103 is 1:2 to 2:1 such that the second anti-tilt member 102 is connected to the middle part of the back plate or within a region proximal to the middle part. When the back plate is fixed onto the wall by an adhesive, such a structure causes the entire back surface of the back plate to withstand a force instead of single-point force withstanding, such that adhesive looseness may be effectively prevented, and the adhesion between the anti-tilt assembly and the wall may be enhanced.

Preferably, the ratio of the width of the first anti-tilt member 101 to the width of the third anti-tilt member 103 is 1:1.5 (2:3). With such a width ratio configuration, the anti-tilt assembly may be most securely fixed to the wall by the adhesive.

In some other embodiments, a through hole 105 is disposed in the second anti-tilt member 102. The through hole 105 is totally or partially surrounded by the second anti-tilt member 102, and when the through hole 105 is partially surrounded by the second anti-tilt member 102, the second anti-tilt member 102 is capable of restraining the through hole 105 in the X axis direction.

The anti-tilt assembly of the cabinet further includes the secondary connecting member 200 fitted into the through hole 105. The secondary connecting member 200 includes the fixing member 201. The fixing member 201 is fitted into the through hole 105 and is hence restrained by the second anti-tilt member 102 in at least the X axis direction, such that the fixing member 201 is indisplaceable in the X axis direction. Meanwhile, the bottom surface of the fixing member 201 is connected to the top surface or the side surface of the cabinet by the adhesive. Specifically, a 3M adhesive may be pre-applied, or a 3M adhesive may be applied during use.

With respect to the anti-tilt assembly of the cabinet constituted by the back plate and the secondary connecting member, indisplaceable cooperation of the secondary connecting member 200 in the X axis direction is indispensable. However, no special requirement is imposed on whether or not a restraining effect is exerted in the Y axis direction.

Preferably, after the secondary connecting member 200 is fitted into the through hole 105, the secondary connecting member 200 is restrained in both the X axis direction and the Y axis direction, and any displacement is impossible. The secondary connecting member 200 is only capable of moving relative to the second anti-tilt member 102 in the Z axis direction to be fitted into the through hole 105 or removed from the through hole 105. In this way, the installation is convenient, and the desired anti-tilt effect is achieved.

Therefore, the first connecting surface 11 having a large area and disposed on the back plate is sufficiently in contact with the wall, such that an adhesive effect between the anti-tilt assembly and the wall is ensured. In addition, the T-shaped structure also ensures that the first connecting surface 11 entirely withstands a force instead of partially withstanding the force. In this way, adhesive looseness of the first connecting surface 11 may be prevented. The fixing member 201 disposed on the secondary connecting member 200 as the second connecting surface has a relatively small contact area due to a side load condition, which still achieves the same adhesive effect. In addition, during assembly and removal, a vertical load is applied, and thus the assembly and the removal are convenient. In addition, the number of actually used anti-tilt assemblies may be correspondingly determined according to the height, size and the like of the cabinet. With respect to a larger or higher cabinet, theoretically, more anti-tilt assemblies may be used to ensure a sufficient fixation effect.

Accordingly, the second anti-tilt member 102 is in a C shape, wherein openings at both ends of the second anti-tilt member 102 are connected to the back plate or integrally molded with the back plate to define a closed through hole 105, such that the secondary connecting member 200 is disposed as being movable relative to the second anti-tilt member 102 in the Z axis direction.

In a preferred embodiment, the secondary connecting member 200 is further provided with a groove 203. The groove 203 may be defined under cooperation between the fixing member 201 and an outer edge 202. Meanwhile, the second anti-tilt member 102 is provided with a protrusive ring 1021. After the secondary connecting member 200 is fitted with the back plate, the protrusive ring 1021 is fitted into the groove 203, such that the secondary connecting member 200 is more securely fitted with the back plate. More preferably, several reinforcing ribs are disposed on inner side surfaces of the protrusive ring 1021 and the first anti-tilt member 101 respectively to enhance the structural strength. Most preferably, at least a portion of the first anti-tilt member 101 and the second anti-tilt member 102 is covered by the outer edge 202 of the secondary connecting member 200, such that the anti-tilt assembly of the cabinet entirely seems to be organized. In addition, the secondary connecting member 200 further includes a back groove 204, such that the first anti-tilt member 101 is fitted into the back groove 204.

The invention claimed is:

1. An anti-tilt assembly of a cabinet, comprising a first anti-tilt member and a second anti-tilt member that are respectively connected to a fixing surface and the cabinet; wherein the first anti-tilt member is disposed at an angle of 90 degrees relative to the second anti-tilt member, a second end of the first anti-tilt member is connected to a first end of the second anti-tilt member, or the first anti-tilt member and the second anti-tilt member are integrally molded;

a first connecting surface is defined outside the first anti-tilt member, and a second connecting surface is defined under the second anti-tilt member; wherein the first connecting surface is configured to be connected to the fixing surface, and the second connecting surface is configured to be connected to the cabinet to fix a top portion or an upper portion of the cabinet to the fixing surface;

a through hole is disposed in the second anti-tilt member, wherein the through hole is totally or partially surrounded by the second anti-tilt member; and a secondary connecting member fitted into the through hole, wherein a fixing member is disposed on the secondary connecting member, the fixing member being fitted into the through hole such that the secondary connecting member is restrained by the second anti-tilt member in an X axis direction; the secondary connecting member is movably disposed in a Z axis direction relative to the second anti-tilt member, and comes to be fitted into the through hole or removed from the through hole along the Z axis direction.

2. The anti-tilt assembly of the cabinet according to claim 1, further comprising a third anti-tilt member; wherein the third anti-tilt member is disposed coplanar with the first anti-tilt member, the first anti-tilt member and the third anti-tilt member constitute a back plate; wherein the first connecting surface is disposed on an outer side surface of the back plate, and the first end of the second anti-tilt member is disposed in a middle area of the back plate to define a T-shaped primary connecting member.

3. The anti-tilt assembly of the cabinet according to claim 2, wherein a ratio of a width of the first anti-tilt member to a width of the third anti-tilt member is 1:2 to 2:1.

4. The anti-tilt assembly of the cabinet according to claim 2, wherein the second anti-tilt member is in a C shape, and openings at both ends of the second anti-tilt member are connected to or integrally molded with the back plate to define a closed through hole.

5. The anti-tilt assembly of the cabinet according to claim 4, wherein a groove is disposed on the secondary connecting member, wherein the groove is defined under cooperation between the fixing member and an outer edge; and a protrusive ring fitted with the groove is correspondingly disposed on the second anti-tilt member.

6. The anti-tilt assembly of the cabinet according to claim 4, further comprising a back adhesive, wherein the back adhesive is applied on the first connecting surface on the outer side surface of the back plate and on a bottom surface of the fixing member.

7. The anti-tilt assembly of the cabinet according to claim 2, wherein the ratio of the width of the first anti-tilt member to the width of the third anti-tilt member is 2:3.

8. The anti-tilt assembly of the cabinet according to claim 1, wherein the second anti-tilt member is in a C shape, and openings at both ends of the second anti-tilt member are connected to or integrally molded with the back plate to define a closed through hole; and a groove is disposed on the secondary connecting member, wherein the groove is defined under cooperation between the fixing member and an outer edge; and a protrusive ring fitted with the groove is correspondingly disposed on the second anti-tilt member.

* * * * *